US005704549A

United States Patent [19]

Kephart et al.

[11] Patent Number: 5,704,549

[45] Date of Patent: Jan. 6, 1998

[54] OSCILLATING SPRINKLER

[75] Inventors: Richard C. Kephart, Northfield; Peter C. McEachen, Cleveland Heights; Douglas Zlatic, North Royalton, all of Ohio

[73] Assignee: The Little Tikes Company, Hudson, Ohio

[21] Appl. No.: 678,869

[22] Filed: Jul. 12, 1996

[51] Int. Cl.[6] ..... B05B 3/06; B05B 3/08

[52] U.S. Cl. ..... 239/236; 239/251; 239/DIG. 1

[58] Field of Search ..... 239/225.1, 236, 239/243, 245, 251, 273, DIG. 1

[56] References Cited

U.S. PATENT DOCUMENTS

| | | | |
|---|---|---|---|
| 1,796,942 | 3/1931 | Pottenger, Jr. . | |
| 1,831,540 | 11/1931 | Nelson | 239/DIG. 1 X |
| 1,938,838 | 12/1933 | Jacobson | 239/236 |
| 1,962,308 | 6/1934 | Jacobson . | |
| 2,475,537 | 7/1949 | Ashworth | 239/236 X |
| 2,601,559 | 6/1952 | Riblet | 299/18 |
| 2,967,024 | 7/1961 | Aubert | 239/251 X |
| 3,458,136 | 7/1969 | Belaieff | 239/251 X |
| 3,878,990 | 4/1975 | Geraudie | 239/236 |

*Primary Examiner*—Lesley D. Morris
*Assistant Examiner*—Robin O. Evans
*Attorney, Agent, or Firm*—Richard B. O'Planick; Lisa B. Riedesel

[57] ABSTRACT

An oscillating sprinkler comprises a fixed base assembly (12) and an upper housing (14) from which water distributing arms (16, 18, 20, 22) extend. A bearing member (66) depends from the upper housing (14) and is seated within the base assembly (12). An upper surface (26) of the base housing (12) comprises an undulating cam surface and bend portions (110) of the arm members act as cam followers. Bend portions (110) engage cam surface (26) and cause a reciprocal tilting of the upper housing (14) about the bearing member (66) as the upper housing (14) rotates about the base assembly (12). Water ejected from orifices (114) in the arm members (16, 18, 20, 22) act to propel the upper housing along its rotational path. A cap member (144) is rotationally mounted to the top of the upper housing (14) and pressurized water ejected through orifices (148) in the cap member (144) act to rotate the cap member in a direction opposite to the direction in which the upper housing rotates.

30 Claims, 7 Drawing Sheets

OSCILLATING SPRINKLER

BACKGROUND OF THE INVENTION

1. Field of the Invention

The invention relates generally to sprinklers for recreational or lawn and garden applications, and specifically to cam actuated oscillating sprinklers.

2. The Prior Art

Oscillating sprinkler assemblies are well known consumer items, used both for recreational toys for young children and as a watering mechanism for lawn and garden applications. Known sprinklers comprise a pivoting turret mounted to a stationary base and multiple arms extending from the turret and rotating therewith about a vertical axis extending through the base. Water is channeled through the base and turret to the arm members, and exits through portals in the arms. Reactionary forces to the exiting water stream propel the turret in a circular path.

In order to cover an expanded area with discharged water, conventional sprinklers provide the means to oscillate the arm members upward and downward as the arms circle the base. Typically an undulating cam surface is provided coaxial with the axis of revolution, and a cam follower is provided to depend from each arm to engage and follow the cam surface. In so doing, the cam follower moves its associate arm member upward and downward, whereby varying the angle of projection of the stream of water from the arm and increasing the covered area.

U.S. Pat. Nos. 1,962,308 and 1,938,838 teach sprinklers generally comporting with the above description. The sprinklers work well and adequately perform their intended purpose. Several deficiencies in these state of the art sprinklers, however, make their performance and operating mechanisms less than optimal. First, the cam followers employed by each are relatively complex and can be prone to failure or breakage.

Secondly, each arm of the sprinkler must be attached to the rotating upper housing by means that will allow each arm to independently oscillate in the vertical direction. The attachments that allow for such movement are relatively complex and, again, can fail. Failure of any arm attachment or cam actuation mechanism will disable the entire sprinkler apparatus.

In addition, these known sprinklers are relatively indistinguishable in their operation and, therefore, lack visual interest. While visual interest is not important in lawn and garden applications, sprinklers are often used by young children for recreational play. The utilitarian mode of operation inherent in state of the art sprinklers provide little play value and minimal visual interest to young children.

SUMMARY OF THE INVENTION

The subject invention overcomes the aforementioned deficiencies in state of the art oscillating sprinklers by providing a mechanism having relatively few, less complex, component parts that operate in a manner less prone to failure. In addition, the mode of operation provides enhanced visual interest and therefore an increased commercial appeal. A sprinkler is provided having a stationary base member and an upper housing rotationally mounted thereto. The upper housing has a dependent ball bearing portion that is seated within a socket within the base member. Accordingly, the upper housing can tilt into various alternative angular attitudes as it rotates about the base member.

An undulating cam surface is provide that encircles the base member. Four arm members project from the upper housing at a fixed angle of projection and are configured having an intermediate bend portion that engage and follows the cam surface, whereby tilting the upper housing into a sequence of alternative angular attitudes as the upper housing rotates about the base. The relative position of the arm members is such that an arm on one side of the upper housing encounters a relatively high portion of the cam surface as the arm on the opposite side encounters a low portion. Tilting of the upper housing is thereby effected.

Water is channeled through the base member and ball bearing member to the upper housing and thence to the arm members where it is discharged through orifices. Reactionary forces to the discharge of water act to move the upper housing in its circular path about the cam surface. The discharge stream from each orifice varies in angle of trajectory as the arm member tilts upward and downward with the upper housing.

A secondary water discharging cap member is provided on the upper housing, and rotates about the upper housing as the upper housing rotates about the base member. Water is channeled through the cap member and is discharged therefrom through orifices in the top of the cap member. Reactionary forces to discharge of water rotates the cap member and the orifices are arranged such that the direction in which the cap member rotates is contrary to the direction in which the upper housing rotates, adding visual interest and appeal to the sprinkler. The discharge stream from each orifice in the cap member varies in its angle of trajectory as the cap member tilts side to side with the upper housing as the housing rotates about the base member.

Accordingly, it is an objective to provide a sprinkler that oscillates to distribute discharged water over a wide area.

A further objective is to provide a cam actuated sprinkler comprising relatively few component parts that combine and operate in a reliable manner.

Still another objective is to provide an oscillating sprinkler in which the arms extend at a fixed angle of projection from the rotating upper turret.

An additional objective is to provide a sprinkler having multiple rotary components that rotate in different directions powered by the same water source.

An objective is also to provide a sprinkler having enhanced visual and interest appeal.

A further objective is to provide a sprinkler that is economical to produce and assembly and convenient to use.

These and other objectives, which will apparent to those skilled in the art, are achieved by a preferred embodiment that is described in detail below and illustrated in the accompanying drawings.

DESCRIPTION OF THE PREFERRED EMBODIMENT

Figure 1:
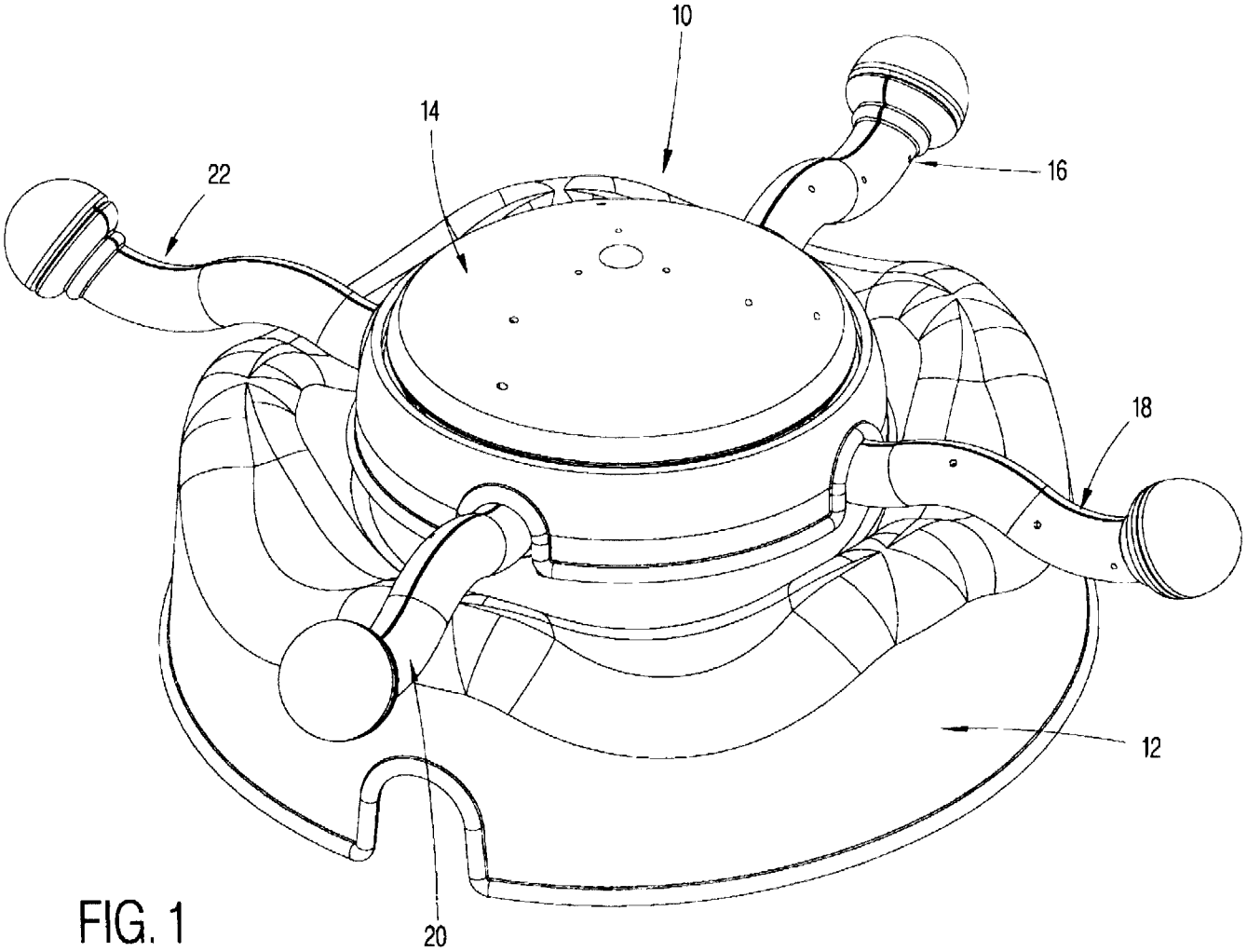
FIG. 1 is an assembled perspective view of the subject sprinkler.
Figure 2:
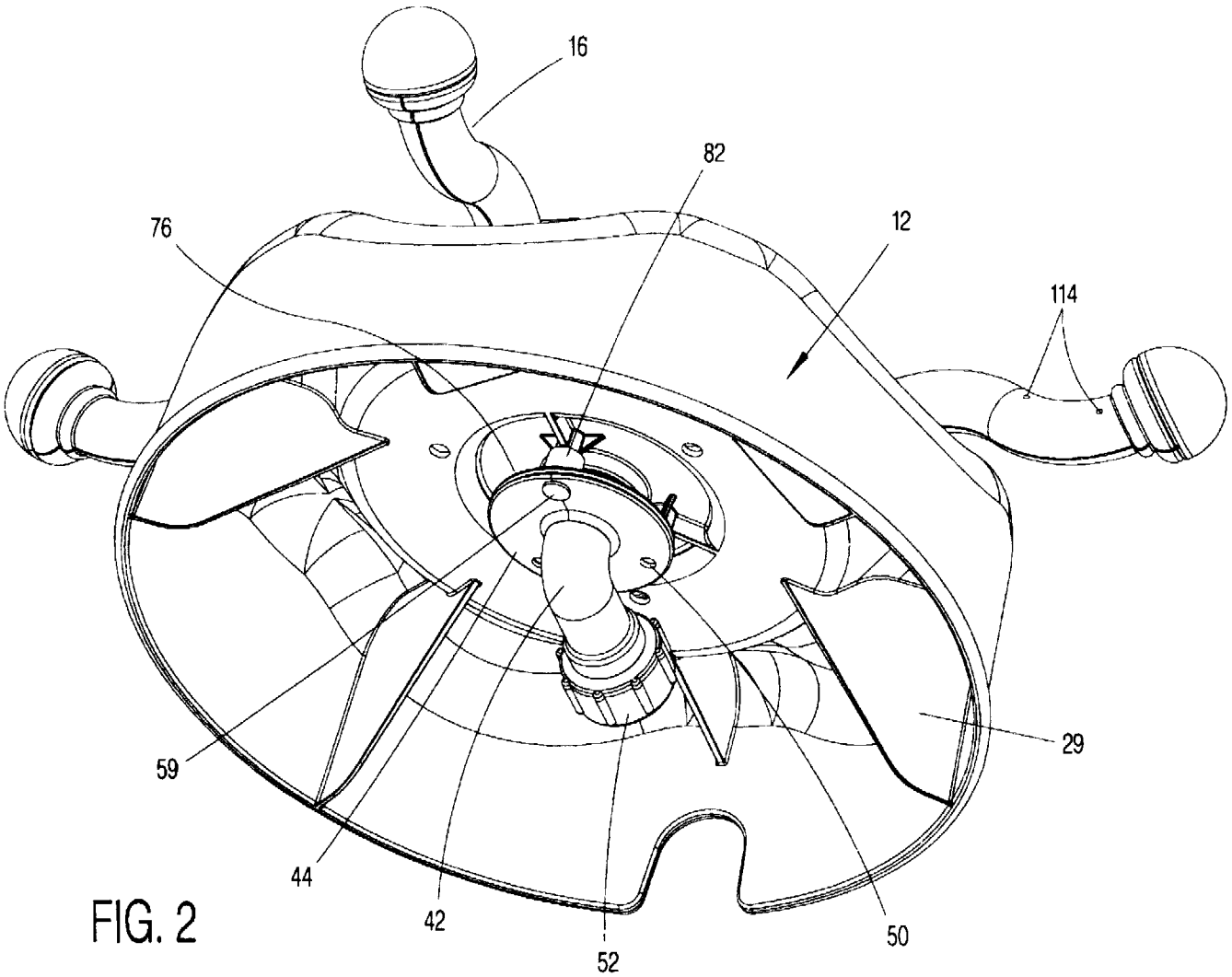
FIG. 2 is a bottom perspective view thereof.
Figure 3:
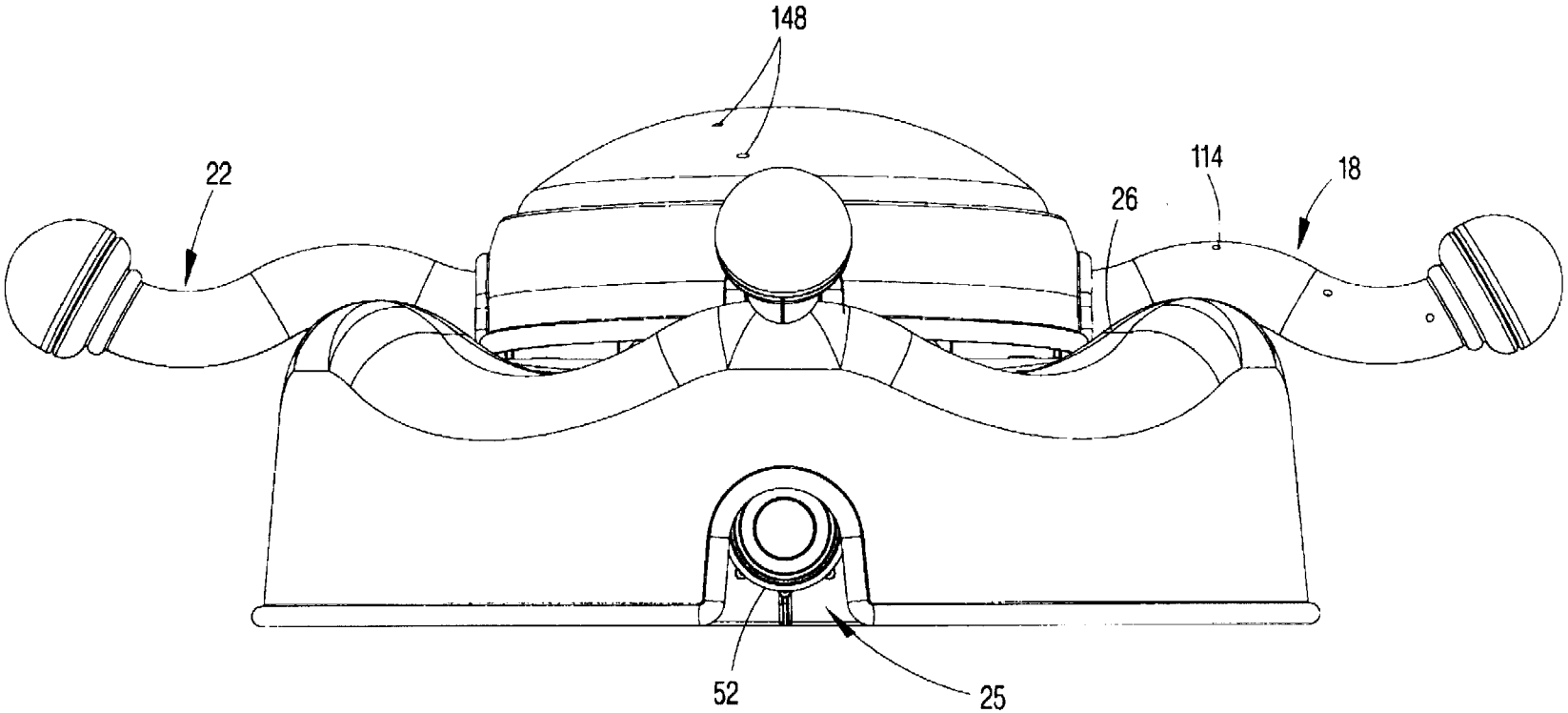
FIG. 3 is a side elevation view thereof.
Figure 4:
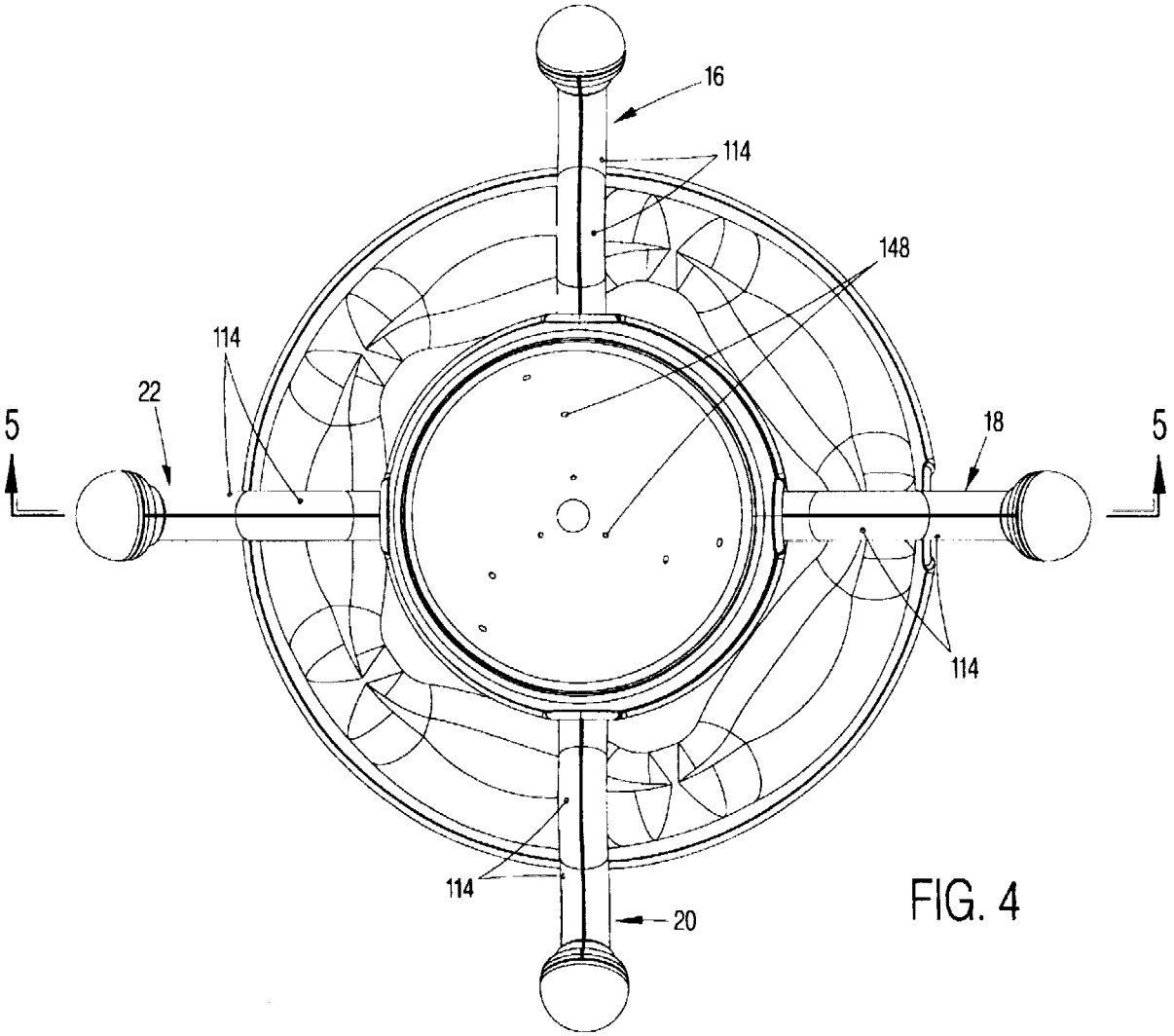
FIG. 4 is a top plan view thereof.

Referring to FIGS. 1, 5, 6 and 7, the subject sprinkler assembly 10 is shown to comprise a base housing 12, an upper housing assembly 14, and four elongate and serpentine profiled arm members 16, 18, 20, 22 projecting outward from the upper housing assembly 14 spaced ninety degrees apart from each other. The base housing 12 is of molded plastic construction, having dependent sidewalls 24 extending to a lower edge 28. A semi-circular opening 25 through the sidewall 24 at edge 28 is sized to accept a water hose therethrough. An undulating cam surface 26 is formed at the top of the housing and represents a circular track.

The housing 12 has an internal chamber 30 and a tubular sleeve 32 extending upward from the top surface 26. An axial bore 34 extends through the sleeve 32 and communicates with the chamber 30. The bore 34 and sleeve 32 are disposed in the center of the housing 12 and the cam surface 26 extends coaxially around the sleeve 32. A peripheral annular shoulder 36 surrounds the sleeve 32 and three screw bores 38 are formed to extend upwardly into the shoulder 36, accessible from inside of the chamber 30.

A plastic elbow fitting 40 is included in the base housing assembly comprising a right angled pipe 42 having an upper portion 46 and an annular mounting flange 44 at an upper end. An axial bore 48 extends through the tube 42 and three mounting apertures extend through the flange 44, spaced one hundred and twenty degrees apart from each other. At the lower end of the tube 42 a threaded collar 52 is attached to an annular bushing 54. An outward flange 56 at an outer end of the bushing 54 abuts an inwardly directed flange 58 of the collar 52 to attach components 52, 54 together. The opposite end of the bushing 54 is glued into the terminal lower end of the tube 42. Collar 52 is sized and threaded to mate to a standard threaded garden house fitting.

Figure 5:
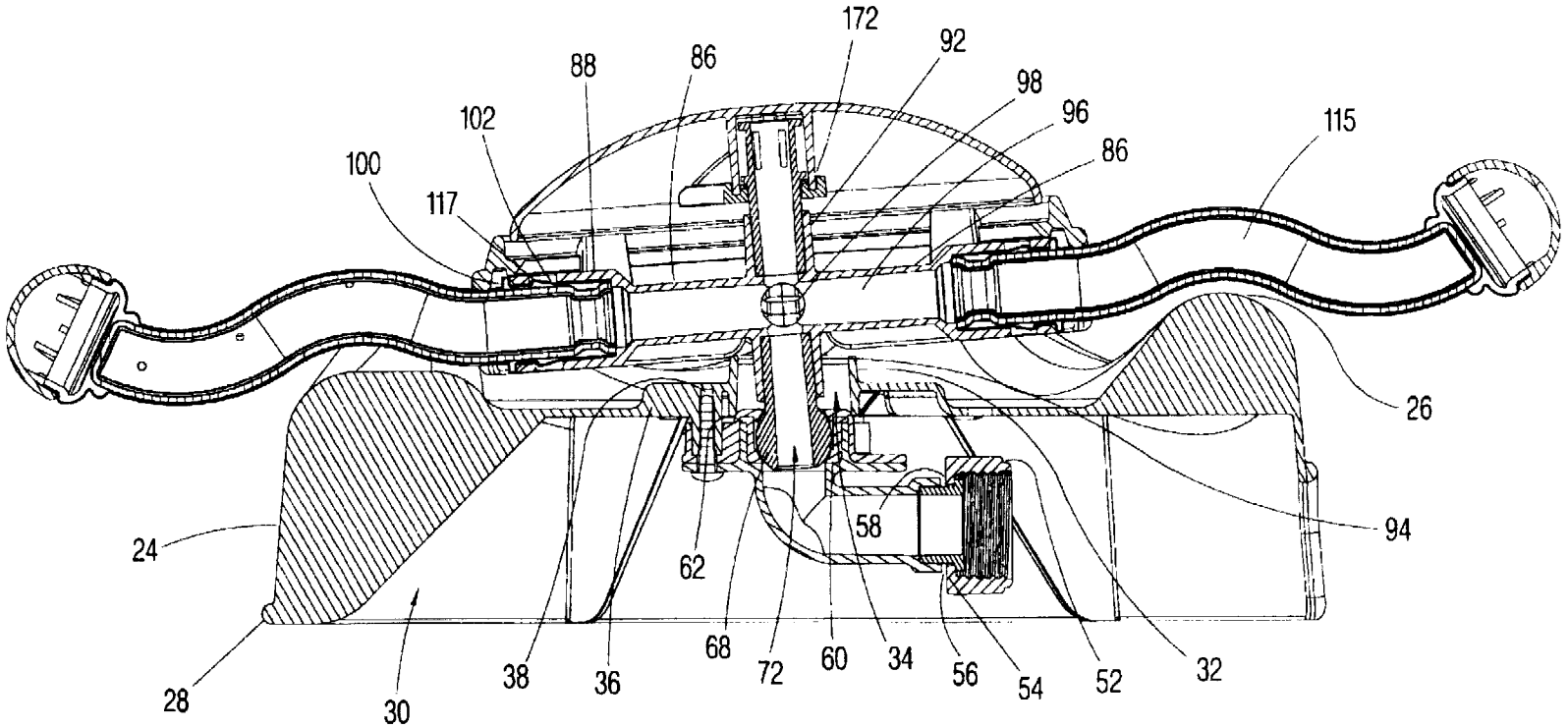
FIG. 5 is a transverse section view thereof taken along the line 5—5 of FIG. 4.

A cylindrical bushing 60 is configured to have an outwardly directed annular flange 62 at an upper end and an inwardly annular flange 64 at an upper end. The lower end of the bushing 60 is sized for close press fit insertion into the upper end 46 of the elbow fitting 40. A bearing pivot member 66 is included, configured having a spherical ball bearing lower portion 68 and a cylindrical upper stem 70. A passageway 72 extends axially through the portion 68 and the stem 70. The spherical ball bearing 68 is sized to seat within the bushing 60, captured therein at the bottom by the lower flange 64 of bushing 60. The passageway 72 aligns axially with the axial bore 48 of the elbow fitting 40 as best seen in FIG. 5.

A retention plate 74 of generally circular shape is disposed over the top portion 46 of the elbow fitting 40. Plate 74 comprises an annular horizontal flange 76, and an axial bore 78 extends through a cylindrical upper sleeve portion 80. Three cylindrical sockets 82, open at both ends, are positioned about the flange 76, each spaced one hundred and twenty degrees apart from the next adjacent socket 82. The plate flange 76 abuts against the flange 44 of the elbow fitting 40, with sockets 82 aligned with apertures 50. So positioned, the stem portion 70 of the member 66 projects upwardly into the sleeve portion 32 of the housing 12 and the ball portion 68 of member 66 is captured within the bushing 60. There is sufficient clearance between the ball portion 68 and the inner walls of bushing 60, and between the stem 70 and the sleeve 32, to enable the ball bearing portion 68 to freely pivot within the bushing 60 and thereby place the stem portion 70 into variable angular attitudes for a purpose explained below.

The previously described assembly is mounted to an underside of the top surface 26 of the base housing 12 by insertion of screws 59 through the apertures 50 of the elbow fitting 40 and through the sockets 82 and thence through the screw bores 38 of the housing 12. The assembly is thereby fixed within the internal chamber 30 of the housing 12 with the threaded collar 52 of the elbow fitting 40 directed axially toward the opening 25. As will be appreciated, the threaded end of a conventional hose can be inserted through the opening 25 and mated with collar 52, whereby providing a source of pressurized water to through the passageway 48 and through the axial bore 72 of the ball bearing member 66. The bushing 60 is formed of relatively hard plastic. Water passing through the fitting 40 will not escape around the ball bearing 68 but rather be channeled through the bore 72 irregardless of the pivotal position of the bearing 58.

With continued reference to FIGS. 1, 5, 6, and 7, a plastic water manifold 84 of generally circular configuration comprises four cylindrical arms 86 that intersect at the center of manifold 84. The remote ends 88 of each arm 86 constitute an enlarged cylindrical coupling portion. The arms 86 extend across a horizontally disposed circular plate body 90 and an upwardly projecting cylindrical socket 92 and a downwardly projecting cylindrical socket 94 project along the center axis of plate 90 in opposite directions. The arms 86 and sockets 92,94 intersect at the center 98 of the manifold 84 and each arm 86 has an axial internal bore 96 by which water is channeled from the center 98 through each arm 86.

An inwardly directed annular retention flange 100 projects into the bore 96 at a remote end of the end portion 88 of each arm 86, and a pair of diametrically located apertures 102 extend through the walls of each of the arm end portion 88, positioned inward of the flange 100. Upwardly projecting latch fingers 104 are formed from portions of the plate 90 and each finger 104 has an inwardly directed transverse lip 106 at the terminal end thereof.

Each arm member 16, 18, 20 and 22 are of identical molded plastic construction. A serpentine shaped arm body 108 is configured to have an axial internal bore 115 and an upwardly formed bend portion 110 intermediate of the arm length, and a spherical end cap 112 affixed to the end of the body 108 to enclose the bore 115. Three orifices 114 extend through the body 108 of each arms 16, 18, 20, 22, oriented so as to point in a common direction. The orifices 114 communicate with the internal bore 115 of each arm member.

Each arm member is provided with an outwardly directed annular retention flange 116 proximate an inward end and diametrically located triangular latch tabs 117 project outward from each arm member. The inward end of the arm members are inserted into a respective end portion 88 of manifold arm 86 until the latch tabs 117 enter into the apertures 102 and arm flanges 116 are captured within the end portions 88 by inwardly formed manifold lips 100. The arms 16, 18, 20 and 22 are glued at their ends into the water manifold 84 to create a hermetic seal. The arms 16, 18, 20, 22 are held in a fixed position relative to the manifold 84 and each arm member projects horizontally from the manifold at a prescribed and fixed orientation. The inner bore 115 of each arm member is axially aligned with the axial bore 96 of its respective manifold arm 86 and water entering the manifold can flow unobstructed into each of the arm members 16, 18, 20, and 22 and out of the orifices 114 thereof.

The dependent lower socket 94 of the water manifold 84 is sized for press fit receipt of the stem portion 70 of the bearing member 66 therein. As will be appreciated from FIG. 5, insertion of the stem 70 into the manifold socket 94 creates a water path from the lower end of the elbow fitting 40, through the ball bearing bore 72, into the water manifold center 96, and thence into the axial bore 96 of each manifold arm where it is then channeled into each of the arm members 16, 18, 20 and 22.

An upper housing 122 is included in the assembly and includes dependent sidewalls 124 receiving the water manifold 84 therein. Semicircular arm openings 126 are formed in the lower terminal edge of the sidewalls 124 to correspondingly allow projection of the arm members 16, 18, 20 and 22 therethrough. The housing 122 is open at the top and bottom and an inwardly projecting annular retention lip 130 projects from the sidewalls 124 proximate a top end. An annular inwardly directed ledge 131 is located at a top edge of the sidewalls 124 above the lip 130.

An elongate cylindrical cap stem member 132 is formed of plastic material, and includes a lower portion 134, a through bore 136, and an upper portion 138. A series of outlet portals 140 extend through the upper portion 138 and communicates with the bore 136. An annular flange 142 circumscribes the member 132, separating the lower portion 134 from the upper portion 138.

Figure 6:
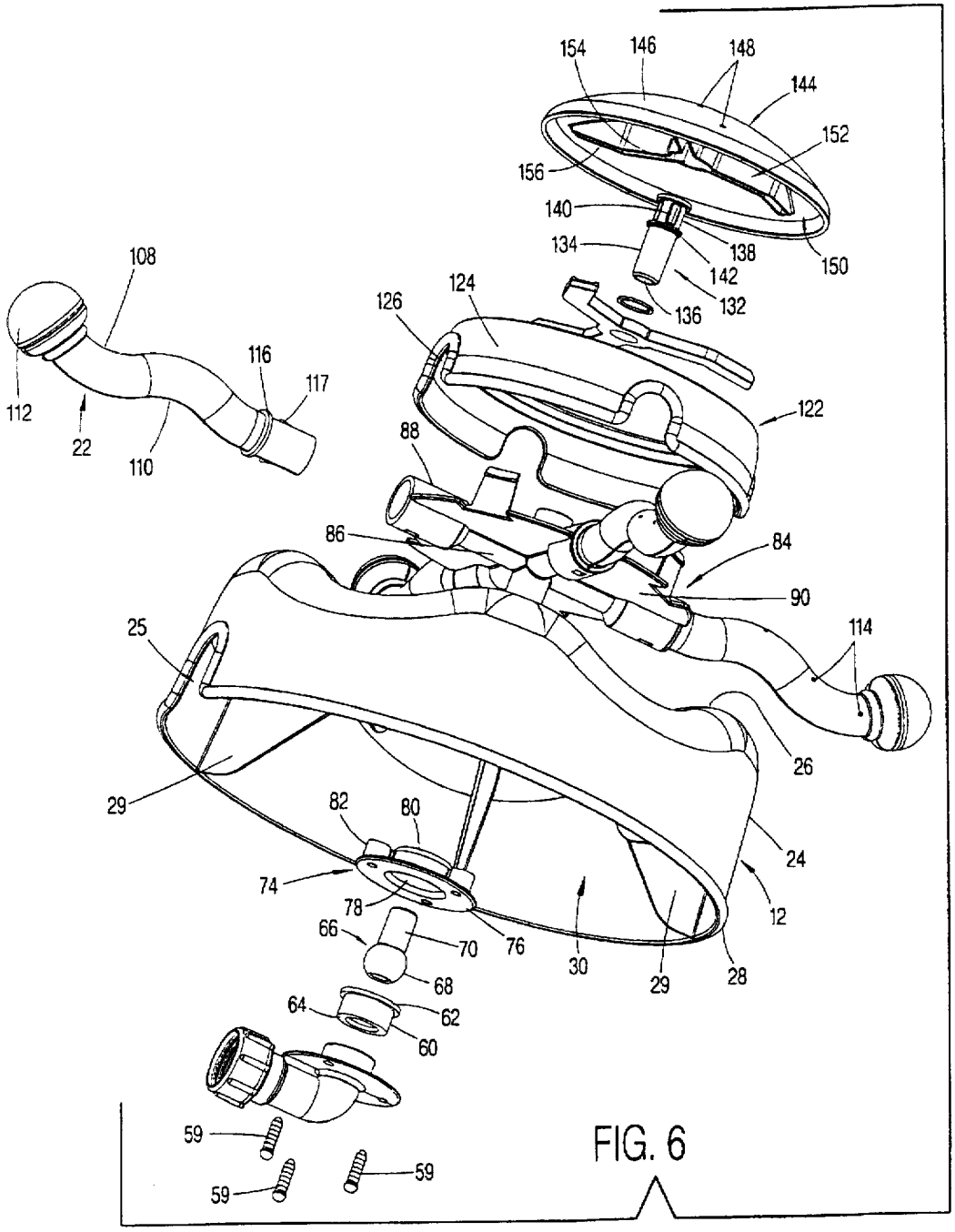
FIG. 6 is a bottom exploded perspective view thereof.
Figure 7:
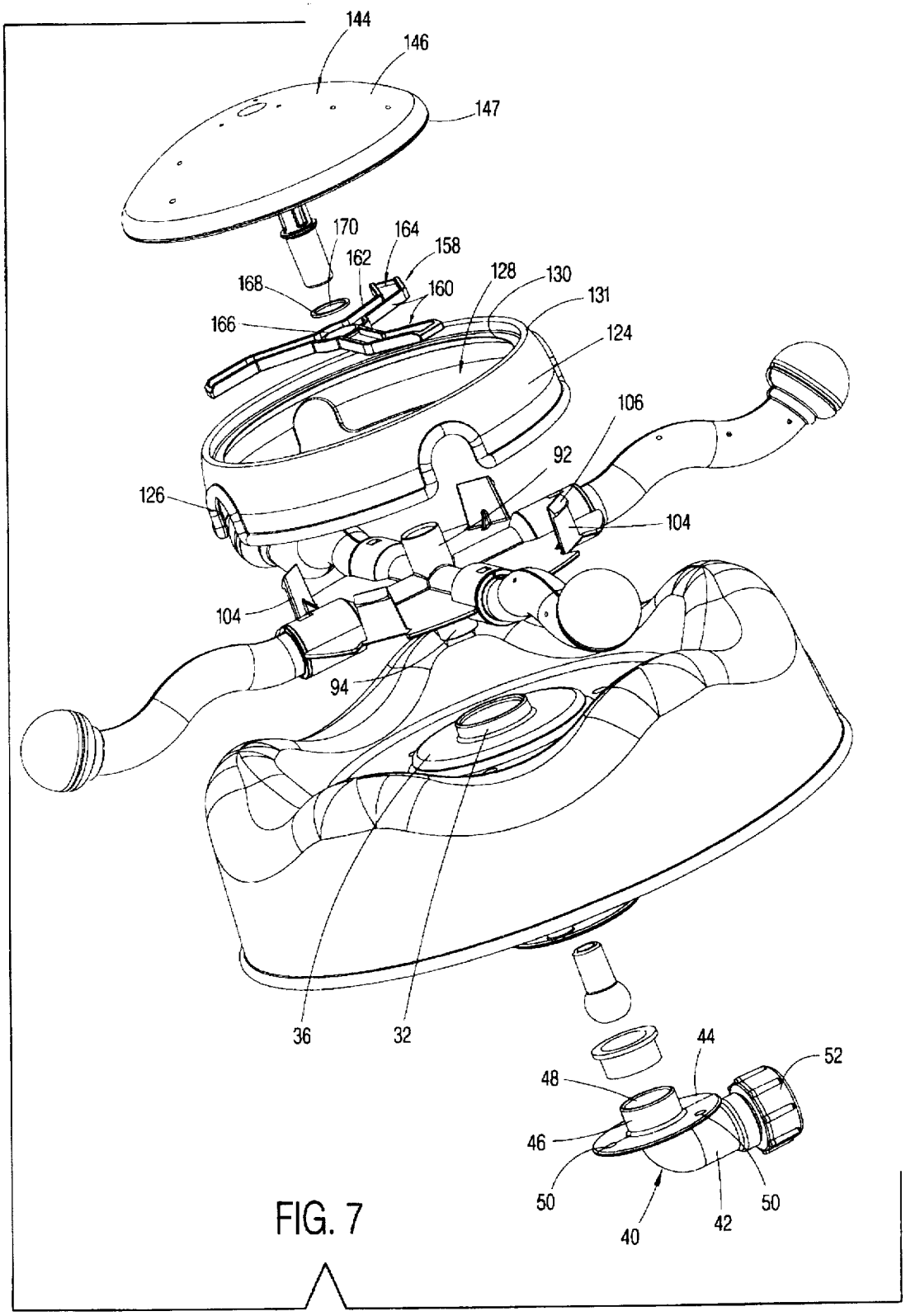
FIG. 7 is a top exploded perspective view thereof.

A dome shaped cap member 144 is provided having a downwardly concave surface 146 terminating at a lower edge 147. Three spiral shaped series of orifices 148 extend through the surface 146 in a prescribed mutual orientation that will be explained below. The domed cap member 144 has an inward chamber 150 and three spiral shaped channels 152 depend downward into the chamber 150, each channel 152 corresponding in shape and location with a respective one of the three series of orifices 148. The channels 152 converge to a central socket 154 as best seen in FIG. 6, and each of the channels 152 has an open lower side 156 as shown.

A channel cap member 158 encloses each of the channels 152 in liquid tight fashion. The member 158 comprises three spiral shaped arms 160 defined by sidewalls 162 and forming an upwardly open channel 164 that extends along each arm 160. The channels 164 merge at a central circular opening 166 extending through the member 158. A retainer ring 168 seats within the opening 166 of the member 158 and includes an upwardly open annular channel 172 and a centrally disposed through hole 170.

The housing 122 receives the water manifold 84 therein as the latch arm end flanges 106 of the manifold snap over the housing lip 130. The upper socket portion 92 of the manifold 84 receives with clearance the lower portion 134 of the cap stem 132. Retainer ring 168 assembles over the lower end 134 of stem 132 and abuts the flange 142 of cap stem 132. Thereafter, the channel cap 158 is received over end 134 of stem 132 and the upper end 138 of stem 132 is inserted into the center socket 154 of the cap member 144. The channel cap arms 160 align over and enclose the channels 152 of the cap member 144 as the upper edges of the sidewalls defining channels 152 are received between the sidewalls of the channel cap arms 160 with interference.

The enclosed channels 152 of the cap member 144 are liquid tight and communicate with the center socket 154 wherein the upper end 138 of the stem 132 resides. The portals 140 of the upper end 138 thus are positioned to direct water which is channeled upward through the stem bore 138 into each of the cap member channels 152. There the water exits from the cap member orifices 148 in a directed stream. The cap member assembly comprising the member 144, the stem 132, and members 168 and 158 assemble into a unitary mechanism that is rotationally mounted to the water manifold 84. The lower end portion 134 of the stem 132 pivotally resides within the upper socket 92 of manifold 84 to allow the cap member assembly to rotate relative thereto independently of the rotation of the upper housing assembly about ball bearing 68.

From the foregoing it will be appreciated that, in the completely assembled sprinkler depicted in FIGS. 1 through 5 inclusive, a water path has been established which directs water received from an outside hose, as follows. The hose connects to the threaded cap 52 and pressurized water from the hose travels through the elbow fitting 40, upwardly through the ball bearing bore 72, and into the center of the manifold 84. There part of the water is directed through the manifold arms 86 into the arm members 16, 18, 20 and 22. A portion of the water continues upward through the stem bore 136 into the center socket 154 of the cap member 144 where it then is channeled into the cap member channels 152.

The upper housing assembly comprises the manifold 84, bearing member 66, housing 122, cap member 144 with stem 132 and associate parts 158, 168, and arms 16, 18, 20, 22. The assembly unitarily rotates about the ball bearing 68 that is seated within the stationary base assembly 12. The base housing 12 rests flat upon the ground and the upper housing assembly rotates about a vertical axis of rotation coincident with the vertical center line of the base assembly. Independently, the cap member assembly rotates about the manifold 84 but both the cap member and the manifold share the same water supply through the same water intake path.

The arm members 16, 18, 20, and 22 extend outward from the manifold 84 at a fixed angle of projection and do not oscillate relative to the manifold 84. The water tight connection between the arms and the manifold can therefore be maintained and not be jeopardized by relative movement between the arm members and the rotating upper housing assembly.

The arm members include bend portions 110 that abut and follow the undulating upper surface 26 of the base housing 12 and act as cam followers. The arm members are positioned at ninety degree stations about the upper housing and the undulations of the cam surface 26 are positioned such that one arm member will encounter a relatively high peak of the cam surface 26 as the opposite arm member encounters a valley. As the first arm climbs a peak of the cam surface 26, the upper housing assembly begins to gradually tilt about ball bearing 68 away from the first arm. The maximum tilt will occur as the first arm member reaches the apex of the peak. At this point the opposite arm member reaches the bottom of a valley located diametrically opposite on the cam surface 26.

Thereafter, the opposite arm begins to climb a peak and initiates a tilt in the opposite direction. Thus, the upper housing as it rotates about a vertical axis of rotation extending through the ball bearing 68, tilts into varying angular attitudes. In so doing, the arm members 16, 18, 20, and 22 tilt unitarily with the upper housing into varying angles of projection relative to the fixed base 12.

Water projected under force from the arm member orifices 114 propel the upper housing in a counter-clockwise direction. The orifices 114 are located along the left side of each arm member such that reactionary forces resulting from the discharge of pressurized water therefrom will act to move the upper housing in the counter-clockwise direction. As the upper housing rotates about the base assembly and tilts into varying angular attitudes, the water stream from each orifice 114 will likewise vary in its angle of trajectory. The area covered by the streams of water from the orifices 114 will therefore be enlarged by the continual variation in the angle of water trajectory.

From the foregoing, it will be appreciated that the upper housing tilts back and forth as it rotates about the base assembly, adding visual interest and novelty to the sprinkler. If used as a recreational device, the unique motion of the upper housing results in enhanced user appeal. Moreover, the elongate arm members tilt back and forth with the upper housing in unitary fashion, making the sprinkler resemble the movement of an insect or other animal. By incorporating an animal appearance into the sprinkler, the appeal of the device to youthful users will further be enhanced.

The cap member receives water from the same inlet path and directs the pressurized water out of orifices 148. The spiral configuration of the orifices 148 are oriented such that the ejection of water from the orifices will cause a rotation of the cap member in a clockwise direction. Reactionary forces resulting from the discharge of pressurized water therefrom will act to move the cap member in a clockwise direction simultaneous with the rotation of the cap member in a counter-clockwise direction with the upper housing about the base assembly. Thus, water is ejected through orifices 148 in a clockwise rotation while water is ejected through orifices 114 in a counter-clockwise direction. Increased visual appeal and user interest in the operation of the sprinkler results.

It will be noted that the subject invention provides a sprinkler comprising relatively few component parts, assembled with few fasteners or hardware. Cost effective manufacture and assembly is therefore achieved. Moreover, the sprinkler incorporates a single inlet water path that distributes pressurized water to multiple outlet ports. Ejection of water from those ports drives the upper housing and the cap member in two rotational directions. The orifices 114 and 148 are arranged as shown to effect the intended directional rotation.

Finally, the upper housing angularly tilts in a repeating sequence as it rotates about the base assembly, casting ejected water across a wide area and adding visual appeal and interest to the device. The fixed relationship of the arm members to the water manifold maintains the liquid tight integrity of the connection therebetween and minimizes the likelihood that leaks will occur. Lastly, bends in the arm members serve as cam followers and initiate changes in the angular attitude of the upper housing as it rotates about the base. Use of the arm members 16, 18, 20, and 22 is for the multiple purposes of water distribution, propulsion of the upper housing, and as cam followers for initiating angular manipulation of the upper housing. Economies achieved thereby reduces the number of parts required and makes the sprinkler assembly economical to manufacture.

While the above describes the preferred embodiment of the subject invention, the invention is not intended to be so limited. Other embodiments, which will be apparent to those skilled in the arts and which utilized the teachings herein set forth are intended to be within the scope and spirit of the invention.

We claim:

1. A sprinkler comprising:

a support base member;

an upper housing rotationally mounted to a top surface of the base member and tilting into variable angular attitudes relative to a vertical axis of rotation as the upper housing rotates about the base member;

a liquid chamber in the upper housing for receiving liquid from an external source; the upper housing comprising at least one elongate arm member rigidly connected at one end to the upper housing and projecting therefrom, the arm member comprising an internal liquid passageway communicating with the liquid chamber and receiving liquid therefrom, and at least one outlet orifice extending through an outer wall of the arm member in communication with the liquid passageway and expelling liquid received therefrom through the orifice; and the arm member rotates and tilts unitarily with the upper housing, and the arm member comprises actuation means for tilting the upper housing as the arm member rotates, whereby varying the arm member angle of projection relative to the vertical axis of rotation.

2. A sprinkler according to claim 1, wherein the upper housing tilts at sequentially varying angular attitudes relative to the vertical axis of rotation as the upper housing rotates, controlled and manipulated by the arm member, whereby sequentially varying the angle at which the arm member projects relative to the vertical axis of rotation.

3. A sprinkler according to claim 2, wherein the actuation means comprising an undulating cam surface coaxial with the axis of rotation and an outer surface of the arm member disposed to engage the cam surface as the arm member rotates to initiate a change in the angular attitude of the upper housing.

4. A sprinkler according to claim 3, wherein the cam surface is an upper surface portion of the base member.

5. A sprinkler according to claim 4, wherein the arm member has an intermediate bend portion complimentarily configured to engage and follow the undulations of the cam surface.

6. A sprinkler according to claim 5, wherein the upper housing is symmetric about a center axis and comprises at least a first and a second arm member projecting outward in opposite directions therefrom, each arm member having an intermediate bend portion complimentarily configured to engage and follow the undulations of the cam surface and the undulations of the cam surface are configured such that one of the arm members encounters a relatively low portion of the cam surface as the opposite arm member encounters a relatively high portion of the cam surface.

7. A sprinkler according to claim 1, wherein the upper housing further comprises a dependent bearing member seated within the support base member coincident with the vertical axis of rotation.

8. A sprinkler according to claim 7, wherein the bearing member comprises a spherical ball bearing seated within a bearing socket within the support base member.

9. A sprinkler according to claim 7, wherein further comprising an liquid intake passageway extending through the bearing member and communicating with the upper housing liquid chamber.

10. A sprinkler according to claim 1, wherein the rotation of the upper housing is propelled by reactionary forces to the discharge of liquid from the arm member.

11. A sprinkler according to claim 10, wherein the upper housing further comprises a rotationally mounted cap member having an internal liquid reservoir communicating with the upper housing liquid chamber and at least one outlet portal for discharging liquid from the reservoir and the rotation of the cap member is propelled by reactionary forces to the discharge of liquid from the outlet portal.

12. A sprinkler according to claim 11, wherein the cap member rotates in a direction opposite to the upper housing.

13. A sprinkler according to claim 11, wherein the cap member tilts and rotates about the vertical axis of rotation unitarily with the upper housing, whereby the angle of discharge of liquid through the outlet portal varies.

14. A sprinkler comprising:

a support base member;

an upper housing rotationally mounted to a top surface of the base member rotating about a vertical axis of rotation in a first direction;

a liquid chamber in the upper housing for containing liquid;

the upper housing comprising at least one outlet orifice extending through an outer wall and communicating with a liquid passageway and expelling liquid therefrom through the orifice; and a cap member rotationally mounted to the upper housing and rotating in a second direction relative thereto contrary to the first direction about a cap member axis of rotation, the cap member further having an internal liquid reservoir communicating with the upper housing liquid chamber and at least one outlet port for discharging liquid from the reservoir and the cap member rotates unitarily with the upper housing about the vertical axis of rotation and rotates simultaneously thereto about the cap member axis of rotation.

15. A sprinkler according to claim 14, wherein the rotation of the upper housing is propelled by reactionary forces to the discharge of liquid through the outlet orifice and the rotation of the cap member is propelled by reactionary forces to the discharge of liquid from the outlet portal.

16. A sprinkler according to claim 15, wherein the cap member rotates in a direction opposite to the direction of rotation of the upper housing.

17. A sprinkler according to claim 14, wherein the upper housing further comprises a dependent bearing member seated within the support base member coincident with the vertical axis of rotation.

18. A sprinkler according to claim 17, wherein the bearing member comprises a spherical ball bearing seated within a bearing socket within the support base member.

19. A sprinkler according to claim 17, wherein further comprising a liquid intake passageway extending through the bearing member and communicating with the upper housing liquid chamber.

20. A sprinkler according to claim 17, wherein the upper housing tilts into variable angular attitudes about the bearing member as it rotates relative to the support base member.

21. A sprinkler according to claim 20, wherein further comprising an undulating, upwardly facing cam surface on the base member disposed coaxial with the vertical axis of rotation and a cam follower member extending from the upper housing and engaging the cam surface, whereby influencing the upper housing as it rotates into a changing angular attitude relative to the vertical axis of rotation.

22. A sprinkler according to claim 21, wherein the cam follower member comprising at least one elongate arm member extending from the upper housing to engage the cam surface, the arm member comprising an internal liquid passageway communicating with the liquid chamber and receiving liquid therefrom, and the upper housing outlet orifice extends through an outer wall of the arm member.

23. A sprinkler according to claim 16, wherein the upper housing tilts into variable angular attitudes as it rotates relative to the support base member.

24. A sprinkler according to claim 23, wherein further comprising an undulating, upwardly facing cam surface on the base member disposed coaxial with the vertical axis of rotation and a cam follower member extending from the upper housing and engaging the cam surface, whereby influencing the upper housing as it rotates into a changing angular attitude relative to the vertical axis of rotation.

25. A sprinkler according to claim 24, wherein the cam follower member comprising at least one elongate arm member extending from the upper housing to engage the cam surface, the arm member comprising an internal liquid passageway communicating with the liquid chamber and receiving liquid therefrom, and the upper housing outlet orifice extends through an outer wall of the arm member.

26. A sprinkler comprising:

a support base member;

an upper housing rotationally mounted to a top surface of the base member and tilting into varying angular attitudes relative to an axis of rotation extending through the base member as the upper housing rotates;

a liquid chamber in the upper housing;

the upper housing comprising at least one outlet orifice extending through an outer wall and communicating with the liquid chamber and discharging liquid therefrom at an expulsion angle of trajectory which varies as the angular attitude of the upper housing varies; and an arm member rigidly connected at one end to the upper housing and projecting therefrom, and the arm member tilting with the upper housing into the varying angular attitudes; and tilt actuation means contacting an arm member portion at a location remote from the upper housing and acting through the arm member to tilt the upper housing into the varying angular attitudes.

27. A sprinkler according to claim 26, wherein the upper housing further comprises a dependent bearing member seated within the support base member coincident with the axis of rotation.

28. A sprinkler according to claim 27, wherein the bearing member comprises a spherical ball bearing seated within a bearing socket within the support base member.

29. A sprinkler according to claim 27, wherein further comprising a liquid intake passageway extending through the bearing member and communicating with the upper housing liquid chamber.

30. A sprinkler according to claim 26, wherein the tilt actuation means comprises an undulating, upwardly facing cam surface on the base member disposed coaxial with the vertical axis of rotation and a cam follower surface of the arm member located remotely from the upper housing and engaging the cam surface, whereby influencing the upper housing as it rotates into a changing angular attitude relative to the vertical axis of rotation.

* * * * *

UNITED STATES PATENT AND TRADEMARK OFFICE

CERTIFICATE OF CORRECTION

PATENT NO. : 5,704,549

DATED : January 6, 1998

INVENTOR(S) : Richard C. Kephart, et al.

It is certified that error appears in the above-indentified patent and that said Letters Patent is hereby corrected as shown below:

Column 10, Line 1, replace "16" with --14--.

Signed and Sealed this

Seventh Day of July, 1998

Bruce Lehman

*Attest:*

BRUCE LEHMAN

*Attesting Officer*

*Commissioner of Patents and Trademarks*